United States Patent [19]

Moroney et al.

[11] Patent Number: 4,802,248

[45] Date of Patent: Feb. 7, 1989

[54] CRIB SPRING HANGER ASSEMBLY

[75] Inventors: John W. Moroney, Glendora; Jugal K. Ralli, Los Angeles, both of Calif.

[73] Assignee: Spalding & Evenflo Companies, Inc., Tampa, Fla.

[21] Appl. No.: 836,370

[22] Filed: Mar. 5, 1986

[51] Int. Cl.[4] ..... A47C 31/00; A47C 19/00

[52] U.S. Cl. ..... 5/11; 5/93 R; 5/207

[58] Field of Search ..... 5/93 R, 200 R, 201, 5/207, 208, 209, 11, 63, 296; 403/406.1, 407.1, 363; 248/224.4, 225.1, 243, 340, 219.4; 297/148, 149, 151

[56] References Cited

U.S. PATENT DOCUMENTS

| | | | |
|---|---|---|---|
| 971,867 | 10/1910 | Weppner | 5/209 |
| 1,618,447 | 2/1927 | Kusterle | 5/100 |
| 2,094,553 | 9/1937 | Shaw | 5/11 |
| 2,240,978 | 5/1941 | Bukolt | 5/93 R |
| 2,297,963 | 10/1942 | Kroll et al. | 5/11 |
| 2,328,316 | 8/1943 | Webb | 5/11 |
| 2,390,580 | 12/1945 | Gertler | 5/201 |
| 2,397,697 | 4/1946 | Shaw | 5/11 |
| 2,447,722 | 8/1948 | Webb | 5/11 |
| 2,478,028 | 8/1949 | Travis | 5/100 |
| 2,562,053 | 7/1951 | Mars et al. | 5/93 R |
| 2,774,081 | 12/1956 | Lukala | 5/99 B |
| 2,845,634 | 8/1958 | Landry | 5/100 |
| 2,845,634 | 8/1958 | Landry | 5/100 X |
| 2,895,144 | 7/1959 | Feldman | 5/207 |
| 2,983,931 | 5/1961 | Nelson | 5/238 |
| 3,129,439 | 4/1964 | Michal | 5/11 X |
| 3,171,140 | 3/1965 | Gutner | 5/296 |
| 3,490,808 | 1/1970 | Siegel | 297/151 |
| 3,636,571 | 1/1972 | Winer | 5/93 R |
| 3,668,721 | 6/1972 | Jenkins | 5/109 |
| 3,760,434 | 9/1973 | Neunherz et al. | 5/11 |
| 4,204,286 | 5/1980 | Stiles et al. | 5/11 |
| 4,285,079 | 8/1981 | Hillman | 5/11 |
| 4,354,287 | 10/1982 | Fredman | 5/201 |

FOREIGN PATENT DOCUMENTS

| | | | |
|---|---|---|---|
| 524393 | 5/1956 | Canada | 5/11 |
| 1052228 | 3/1959 | Fed. Rep. of Germany | 248/243 |
| 1323012 | 2/1963 | France | 248/243 |
| 777202 | 6/1957 | United Kingdom | 108/107 |
| 857075 | 12/1960 | United Kingdom | 403/407 |

*Primary Examiner*—Gary L. Smith
*Assistant Examiner*—Michael F. Trettel
*Attorney, Agent, or Firm*—Donald R. Bahr; John E. Benoit

[57] ABSTRACT

A hanger assembly for supporting a spring from a crib having a plurality of closed loop brackets mounted on each corner post of the crib and a Z-shaped hanger mounted at each corner of the spring frame. One end of the hanger extends outwardly from the spring frame so as to mate with the associated bracket. The outer end has a depending lip which extends below the bracket when the spring is hung in place. Accordingly, the spring must be lifted vertically and moved horizontally in order to remove the hanger from the bracket.

2 Claims, 2 Drawing Sheets

CRIB SPRING HANGER ASSEMBLY

This application relates generally to hangers for securing a spring within a crib and more specifically to a bracket and hanger which prevents accidental disengagement of the spring from the crib.

BACKGROUND OF THE INVENTION

The majority of cribs in use today have provisions for adjusting the spring frame which holds the mattress in an upward or downward position. This allows for growth of the baby and ease of handling the baby for various chores such as diaper changing, etc.

Normally, there is a support structure for the crib mattress and this support structure usually takes the form of a substantially flat spring. Since height adjustment of the spring frame is desired, there are normally provided mounting brackets at each corner of the crib or on each post of the crib itself. These brackets usually include a number of positional bracket locations. In a common usage, a rod is attached at each corner of the spring frame in a position such that it will mate with the brackets and may be placed therein so as to support the crib by means of the hanger and bracket at the desired height.

The brackets which are commonly used are stamped from a metal plate and include an upstanding open loop whereby the rod extending from the spring frame may be placed easily within the loop. Normally, an enlargement exists at the end of the rod so as to prevent horizontal sliding of the rod within the bracket.

In this type of support, the only movement necessary to release the rod hanger from the bracket is a vertical movement whereby it easily slips out of the open loop of the bracket. It has been found that this type of movement can be caused accidentally whereby, if one corner is released or one side is released, the spring support and the mattress tilt downwardly either to the corner or to the side causing the child to roll or slide in that direction. This presents a great danger since the child can then be caught between the mattress and the frame structure of the crib with possible fatal results. Accordingly, it is an object of this invention to provide a crib spring frame hanger assembly which substantially eliminates the possibility of accidental dislodgement of the hanger assembly from the bracket.

Another object of this invention is to provide a crib spring frame hanger assembly wherein two positive movements are required to release the hanger from the bracket.

Yet another object of this invention is to provide a crib spring frame hanger assembly which requires a vertical lifting of the hanger within the bracket and a subsequent horizontal movement of the hanger relative to the bracket before the hanger is released from the bracket.

These and other objects of the invention will become apparent from the following description taken together with the drawings.

SUMMARY OF THE INVENTION

The present invention provides a hanger assembly for supporting a spring from a crib having a plurality of closed loop brackets mounted on each corner post of the crib and a rigid hanger mounted at each corner of the mattress spring support frame. One end of the hanger extends outwardly from the spring frame so as to mate with the associated bracket. The outer end has a depending lip which extends below the bracket when the spring is hung in place. Accordingly, the spring must be lifted vertically and moved horizontally in order to remove the hanger from the bracket.

DETAILED DESCRIPTION OF THE INVENTION

Figure 1:
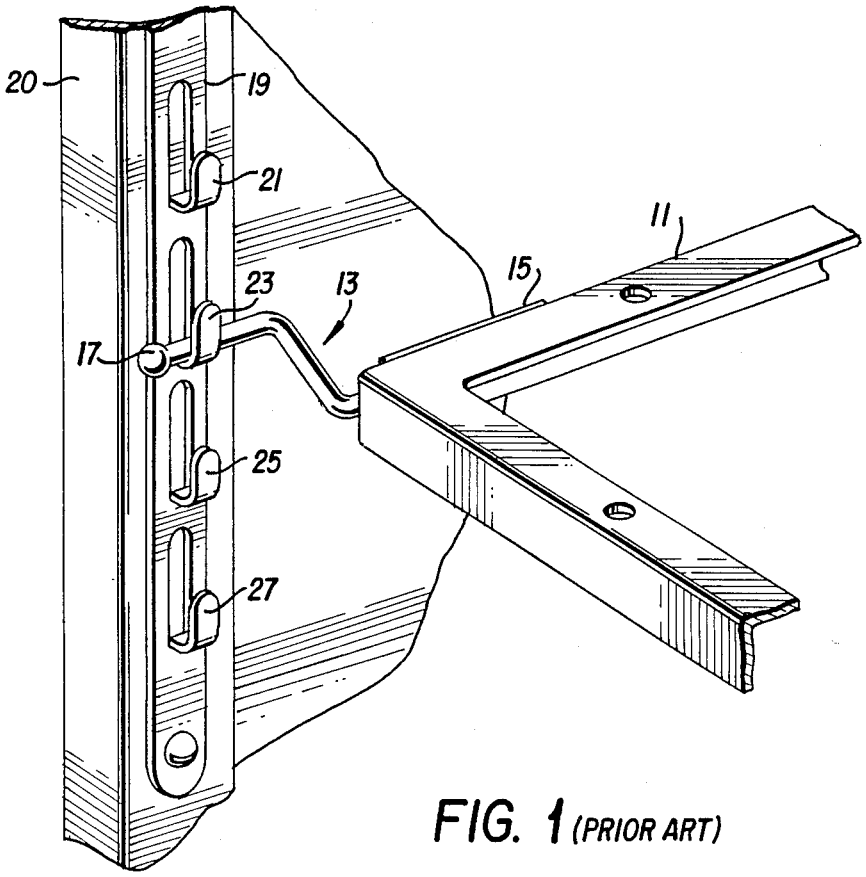
FIG. 1 (PRIOR ART)
FIG. 1 is a partial perspective view of a spring frame hanger and bracket of the prior art.

Turning now to FIG. 1, there is disclosed therein an illustration of the presently known arrangement for supporting a spring frame within a bracket mounted on a crib.

Spring frame 11 has secured thereto Z-shaped wire rod hanger 13 which is pivotally retained within plate 15 which, in turn, may be secured to frame 11 by means such as bolts or the like (not shown). Wire rod hanger 13 terminates in an enlargement or ball 17 at its outer end in order to deter horizontal disengagement from the brackets.

Four-position bracket 19 is secured to crib corner post 20 by any well known means such as screws or the like. Plate 19 has stamped therefrom a plurality of open loop brackets 21, 23, 25 and 27. In the illustration of FIG. 1, hanger 13 is shown resting within bracket 23.

Figure 2:
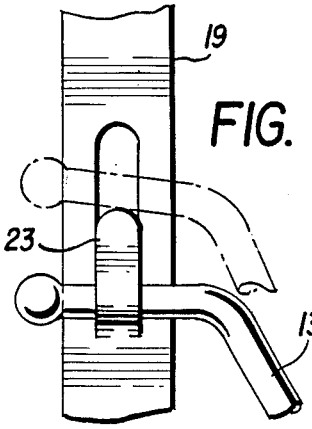
FIG. 2 (PRIOR ART)
FIG. 2 is a partial elevational view illustrating the movement of the hanger of the prior art within the bracket as disclosed in FIG. 1.

Turning to FIG. 2, there is illustrated the problem which is inherent with this type of bracket. The solid lines indicate the hanger 13 sitting within the bracket 23 in the manner as shown in FIG. 1. The dashed lines show the hanger as it is being removed from the bracket. As can be seen, the only movement required for removal is to vertically lift either the hanger 13, or the spring frame attached to hanger 13, and it will disengage itself from bracket 23. Such a vertical movement can be caused by any number of unintentional movements, whether it be by the knee or the hand of the person tending the baby. A bouncing baby can also dislodge the hanger from the bracket. If this happens at one corner or at the two corners of the same side, the spring frame and the mattress will tilt downwardly toward the dislodged hanger or hangers. This will cause the baby to slide or roll in that direction and presents the very dangerous situation wherein the baby could be caught between the mattress and the crib structure. This could result in strangulation or severe injury to the baby.

Figure 3:
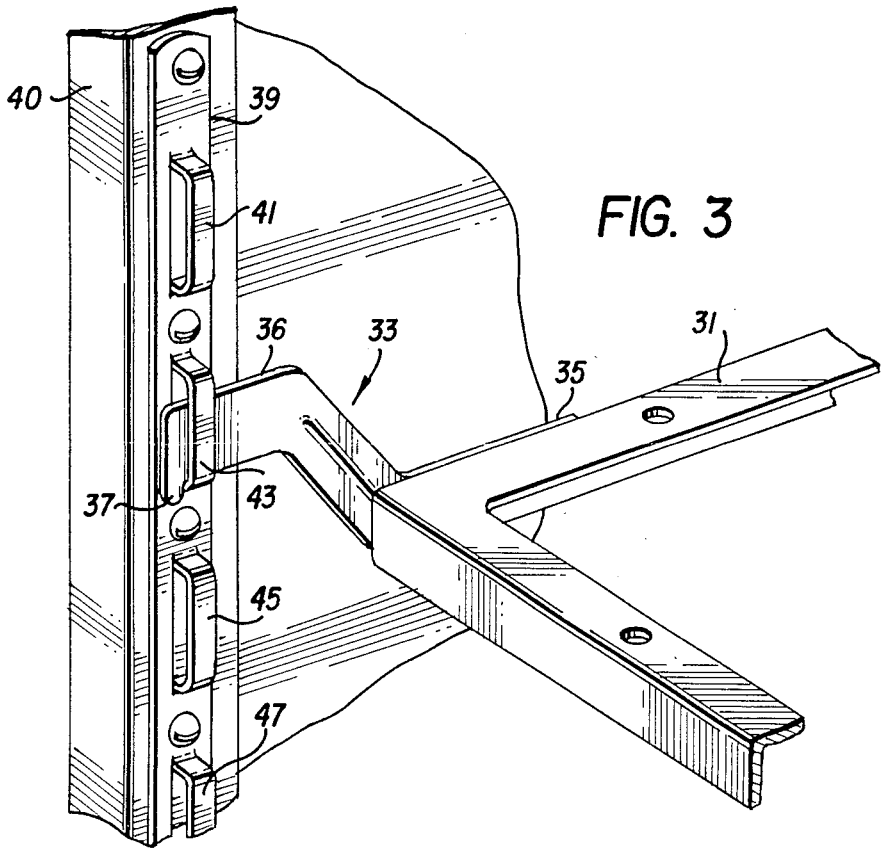
FIG. 3 is a partial perspective view of the hanger and bracket of the present invention as used relative to the crib and the spring frame.

FIG. 3 illustrates one modification of the hanger and bracket of the present invention which is designed to avoid the problems of the prior art discussed above.

Frame 31 is shown as having secured thereto a substantially Z-shaped hanger 33 which is a flat plate of sufficiently gauged steel or the like. One end 35 of the hanger is secured to spring frame 31 by means such as bolts or the like (not shown). The other end 36 of hanger 33 extends parallel to end 35.

Four-position bracket 39 is mounted to crib post 40 by means such as screws or the like. The bracket assembly of this invention includes a plurality of closed loop brackets 41, 43, 45 and 47. These brackets may be struck from a flat plate in a normal stamping fashion if a steel plate is used.

As can be seen, outer end 36 of hanger 33 is of a dimension such that it will pass within the selected closed loop bracket 43. Outer end 36 also has a downwardly extending lip 37, so that when it is in place, the lip will abut against the lower part of closed loop bracket 43 so as to retain the hanger horizontally within the bracket.

Figure 4:
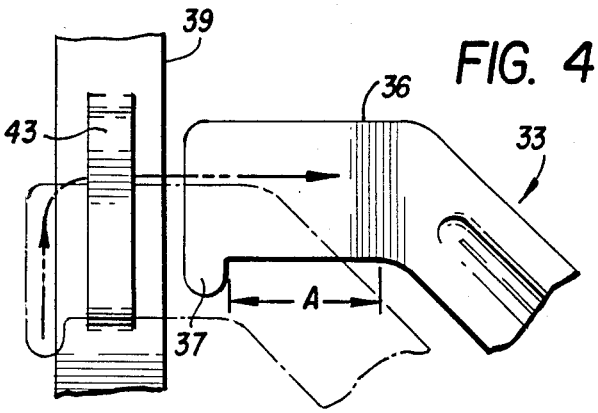
FIG. 4 is an illustration of the movement required to remove the hanger from the bracket of FIG. 3.

Turning now to FIG. 4, the insertion and removal of outer end 36 of bracket 33 within closed loop 43 is illustrated. The dashed lines indicate the hanger 36 in the position as shown in FIG. 3. As indicated by the arrows, hanger 33 must first be lifted in a vertical direction so as to clear lip 37 from the lower part of the bracket and then must be moved in a horizontal direction so as to clear end 36 of the hanger from the bracket.

Figure 5:
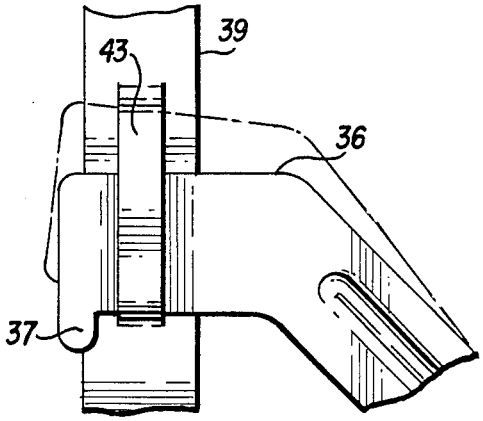
FIG. 5 is a partial elevational view illustrating the retention of the hanger within the bracket under certain conditions.

FIG. 5 illustrates the fact that the hanger cannot be removed from the bracket by a single motion such as a rocking motion or dropping motion. As can be seen by the dashed lines, end 36 of the hanger, if there is a rocking motion, will contact the upper end of bracket 43 and will not allow lip 37 to be released from bracket 43.

Figure 6:
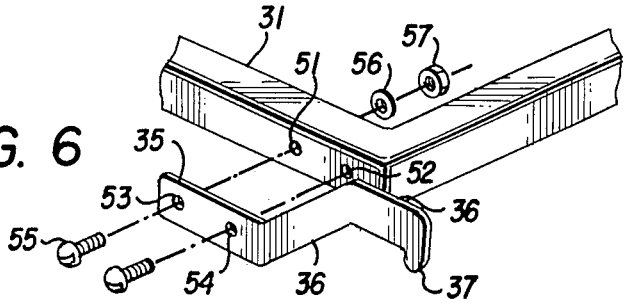
FIG. 6 is a perspective view of one means of attaching the bracket of FIG. 3 to the spring frame.

FIG. 6 discloses one means for mounting hanger 36 of FIG. 3 to spring frame 31. As can be seen, boreholes 51 and 52 are drilled in spring frame 31 and boreholes 53 and 54, having the same spacing as boreholes 51 and 52, are drilled in end 35 of hanger 36. Bolts 55 and associated washers 56 and nuts 57 secure hanger 36 to frame 31.

Figure 7:
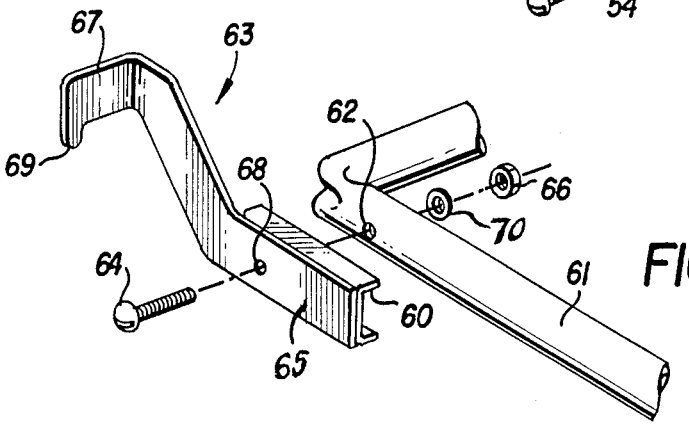
FIG. 7 is a perspective view of a modified hanger for use with the bracket of FIG. 3.

FIG. 7 illustrates a modification of a hanger as adapted for use in a tubular type of spring frame. Frame 61 has a borehole 62 drilled therethrough and end 65 of hanger 63 has a mating borehole 68 drilled therethrough. A C-shaped member 60 is secured to end 65 of hanger 63 by means such as welding, and is of a dimension so as to pass about tubular frame 61. Accordingly, bolt 64, washer 70 and nut 66 secure hanger 63 go frame 61 and C-shaped plate 60 prevents rotation of the hanger relative to the spring frame. The particular hanger 63 is shown as being attached to the long side of the spring frame member. Accordingly, outer end 67 is bent at substantially 90° and includes lip 69 as does the previously described hanger. This allows the hanger to be mated with the brackets of FIG. 3 in a manner similar to that of the previously described hanger.

Referring back to FIG. 4, dimension A, which is the basic length of the upper end of hanger 33 is of a dimension such that, after the hangers on one side of the spring frame are placed in their respective brackets at each of the end posts, they may be moved the distance A into bracket 43 so as to allow the hangers on the opposite side of the crib to be placed within their mating brackets. Accordingly, when the hangers, and, thus, the spring frame is in place, lips 37 on all of the hangers will abut against the lower outer edge of brackets 43 and the spring frame will be restricted from horizontal movement.

It should be noted that, while the Z-shaped bracket is a preferred embodiment when it is desired to hang the spring frame as shown in the drawings, the bracket may have a substantially straight configuration so that the ends of the bracket are at substantially the same elevation when the spring frame is in place.

As will now be obvious, the present invention provides a substantially fail-safe means for mounting a mattress support spring frame within a crib at selected positions substantially removing any danger of accidentally removing the hangers from within their respective brackets.

The above description and drawings are illustrative only since the components can be modified without departing from the present invention, the scope of which is to be limited only by the following claims.

We claim:

1. Apparatus for hanging a spring frame from a crib comprising at least one closed loop bracket support mounted at each corner of a crib;

a removable hanger for mating with and being supported by each of said bracket supports, each of said hangers comprising a rigid plate having two ends, one end of said plate being of a dimension to pass through and rest upon its associated closed loop bracket support whereby said bracket support supports said rigid plate;

a downwardly extending lip at the one end of said plate, said lip extending beyond and below said closed loop bracket support when said plate rests upon said bracket support;

a C-channel secured to the other end of said plate for mating with a spring frame;

mating boreholes through said plate, said C-channel and said spring frame; and a bolt for passing through said boreholes.

2. The apparatus of claim 1 wherein said rigid plate is substantially Z-shaped with the one end being bent at substantially ninety degrees.

* * * * *